US011806576B2

(12) United States Patent
Chen

(10) Patent No.: US 11,806,576 B2
(45) Date of Patent: Nov. 7, 2023

(54) FITNESS EQUIPMENT PROVIDED WITH MASSAGE PEDALS

(71) Applicant: Xiamen Jinen Plastic Co., Ltd., Fujian (CN)

(72) Inventor: Zhishou Chen, Xiamen (CN)

( * ) Notice: Subject to any disclaimer, the term of this patent is extended or adjusted under 35 U.S.C. 154(b) by 193 days.

(21) Appl. No.: 17/429,349

(22) PCT Filed: Apr. 24, 2020

(86) PCT No.: PCT/CN2020/086704
§ 371 (c)(1),
(2) Date: Aug. 9, 2021

(87) PCT Pub. No.: WO2020/224453
PCT Pub. Date: Nov. 12, 2020

(65) Prior Publication Data

US 2022/0008780 A1 Jan. 13, 2022

(30) Foreign Application Priority Data

May 6, 2019 (CN) ..... 201910371987.0

(51) Int. Cl.
*A63B 22/06* (2006.01)
*A61H 39/04* (2006.01)
*A63B 21/22* (2006.01)

(52) U.S. Cl.
CPC ..... *A63B 22/0605* (2013.01); *A61H 39/04* (2013.01); *A63B 21/225* (2013.01); *A61H 2201/1261* (2013.01); *A61H 2201/164* (2013.01); *A61H 2205/125* (2013.01); *A63B 2022/0611* (2013.01)

(58) Field of Classification Search
CPC ..... A63B 22/0605; A63B 21/225; A63B 2022/0611; A63B 22/0664; A63B 21/0058; A61H 39/04; A61H 2201/1261; A61H 2201/164; A61H 2205/125; A61H 2201/0107; A61H 2201/1284; A61H 2201/1671; A61H 2205/12; A61H 7/001
See application file for complete search history.

(56) References Cited

U.S. PATENT DOCUMENTS 2,186,105 A * 1/1940 Harry ..... A61H 23/0254 601/111
10,888,486 B2 * 1/2021 Baek ..... A61H 1/0266
2002/0156404 A1 * 10/2002 Kuo ..... A61H 15/0078 601/87
2009/0306559 A1 * 12/2009 Tsai ..... A61H 7/007 601/134

(Continued)

*Primary Examiner* — Andrew S Lo
*Assistant Examiner* — Andrew M Kobylarz

(57) ABSTRACT

Disclosed is a fitness equipment provided with massage pedals, comprising a frame, two pedals, two rotating shafts, two flywheel swing arms, a flywheel, a damping wheel and a belt; the pedals are mounted on the frame and provided thereon with massage mechanisms; the pedals are connected to the rotating shafts; an inner end of the rotating shafts is rotatably connected to an outer end of the flywheel swing arm; a middle portion of the flywheel swing arm is sleeved on an outer end of a flywheel axle; the flywheel axle penetrates the flywheel, a middle portion of the flywheel axle and the damping wheel are rotatably mounted to the frame; and the belt is wound on the damping wheel and the flywheel.

11 Claims, 8 Drawing Sheets

(56) References Cited

U.S. PATENT DOCUMENTS

| | | | | |
|---|---|---|---|---|
| 2010/0069800 | A1* | 3/2010 | Hsu | A61H 15/02 601/115 |
| 2010/0179460 | A1* | 7/2010 | Tsai | A61H 15/0078 601/134 |
| 2019/0321259 | A1* | 10/2019 | Zhou | A61H 7/007 |
| 2020/0206071 | A1* | 7/2020 | Wu | A61H 1/00 |

* cited by examiner

FITNESS EQUIPMENT PROVIDED WITH MASSAGE PEDALS

BACKGROUND OF THE INVENTION

1. Field of the Invention

The present invention relates to a fitness equipment, and more particularly to a fitness equipment provided with massage pedals.

2. Description of the Prior Art

A stepper exercise machine enables a bodybuilder to repeat the action of climbing s airs, which not only enhances the function of the cardiovascular system but also fully exercises the thigh and calf muscles. A stepper exercise machine adopts a wheel-rotating step design, and is provided with pedals, a flywheel and other components. Most of conventional stepper exercise machines have no massage structure and provide a single function, unable to provide customers with a better user experience.

SUMMARY OF THE INVENTION

The primary object of the present invention is to provide a more fully functional fitness equipment provided with massage pedals.

In order to achieve the above objects, the present invention adopts the following technical solutions:

A fitness equipment provided with massage pedals comprises a frame, two pedals, two rotating shafts, two flywheel swing arms, a flywheel, a damping wheel, and a belt. The two pedals are symmetrically mounted on the frame. The pedals are each provided thereon with a massage mechanism. The pedals are connected to the rotating shafts, respectively. An inner end of each rotating shaft is rotatably connected to an outer end of the flywheel swing arm through a bearing. A middle portion of the flywheel swing arm is sleeved on an outer end of a flywheel axle. The flywheel axle is inserted through the flywheel. A middle portion of the flywheel axle is rotatably mounted to the frame through another bearing. The damping wheel is rotatably mounted to the frame. The belt is wound on the damping wheel and the flywheel.

Preferably, the pedals each include a pedal body, massage pins, a rotating disc, a disc rotating axle, a gear unit, and a bevel gear. The massage pins are movably inserted in perforations defined in a middle portion of the pedal body. Upper end faces of the massage pins extend out of a top surface of the pedal body. Lower end faces of the massage pins abut against a top surface of the rotating disc. A center of the rotating disc is sleeved on an upper end of the disc rotating axle. A lower end of the disc rotating axle is connected to the gear unit. The gear unit is rotatably installed in the pedal body and meshes with the bevel gear. The bevel gear is sleeved on an outer end of the corresponding rotating shaft. The massage pins, the rotating disc, the disc rotating axle, the gear unit and the bevel gear constitute the massage mechanism.

Preferably, the top surface of the rotating disc is a curved surface that curves inward.

Alternatively, the pedals each include a pedal body, a massage disc, a disc rotating axle, a gear unit, and a bevel gear. The massage disc is movably installed in a counterbore on a top surface of the pedal body. A center of the massage disc is sleeved on an upper end of the disc rotating axle. A lower end of the disc rotating axle is connected to the gear unit. The gear unit is rotatably installed in the pedal body and meshes with the bevel gear. The bevel gear is sleeved on an outer end of the corresponding rotating shaft. The massage disc, the disc rotating axle, the gear unit and the bevel gear constitute the massage mechanism.

Preferably, a top surface of the massage disc has a plurality of hemispheres protruding upwardly.

Preferably, the gear unit includes a small bevel gear and a drive gear. An upper portion of the small bevel gear is formed with annularly arranged teeth. A lower portion of the small bevel gear is formed with bevel teeth. The bevel teeth of the lower portion of the small bevel gear mesh with the bevel gear. The annularly arranged teeth of the upper portion of the small bevel gear mesh with the drive gear. The drive gear is sleeved on the disc rotating axle.

Preferably, the gear unit further includes a transition gear. The annularly arranged teeth of the upper portion of the small bevel gear mesh with the transition gear, and the transition gear meshes with the drive gear.

Preferably, one end of the pedal body is equipped with a wheel, and the wheel is slidably connected to a bottom plate of the frame.

With the above solutions, the present invention comprises a frame, two pedals, two rotating shafts, a flywheel swing arm, a flywheel, a damping wheel, and a belt. Each pedal is provided with a massage mechanism. Through the corresponding rotating shaft, the massage mechanism drives a bevel gear to rotate so as to drive the massage mechanism to act, the soles of the user's feet may be massaged by means of a step workout without needing to provide an additional power supply, and the fitness equipment thus has the advantage of the functions thereof being more complete.

Embodiments of the present invention will now be described, by way of example only, with reference to the accompanying drawings.

DETAILED DESCRIPTION OF THE PREFERRED EMBODIMENTS

Figure 1:
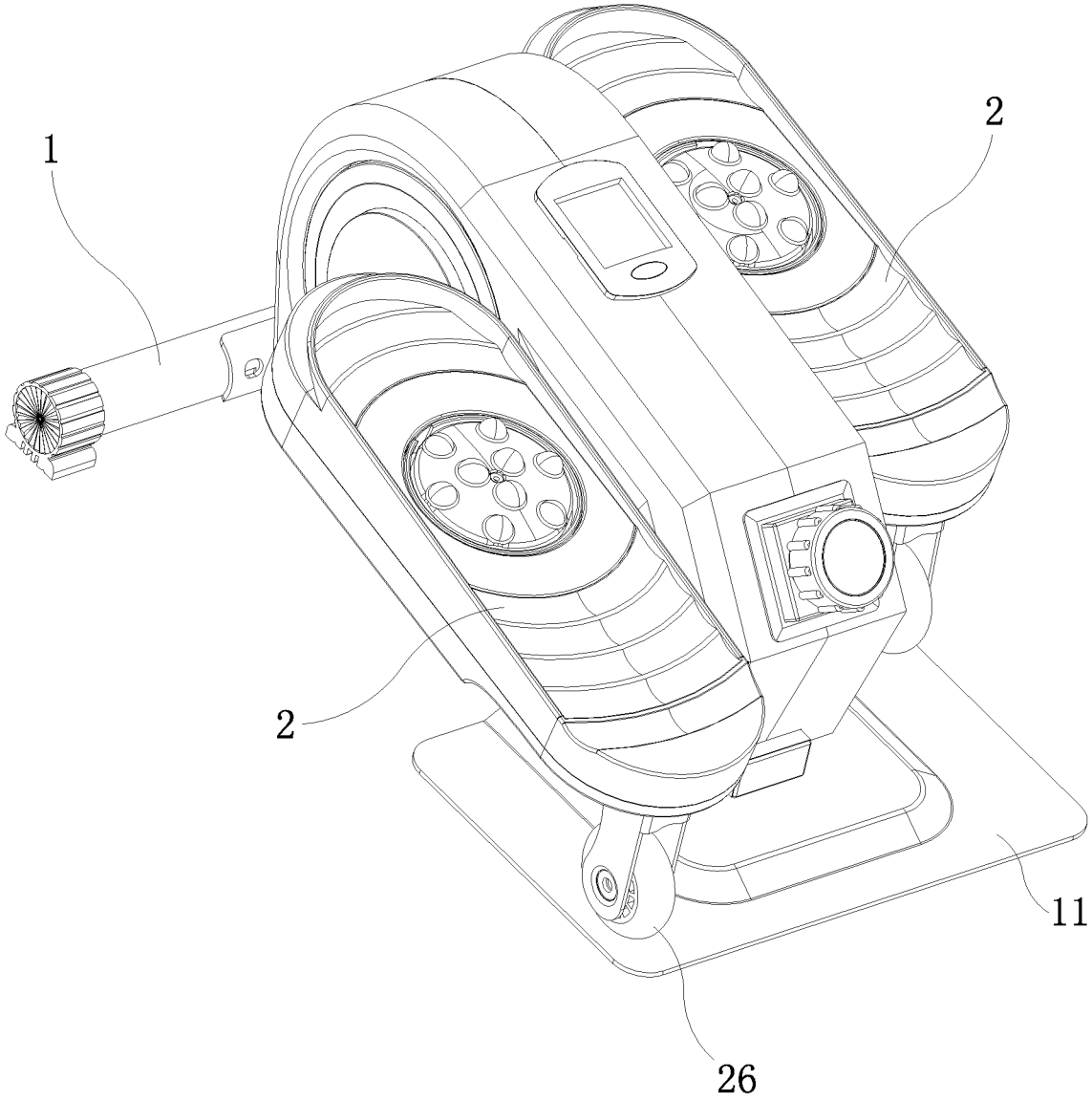
FIG. 1 is a perspective view of the present invention.
Figure 2:
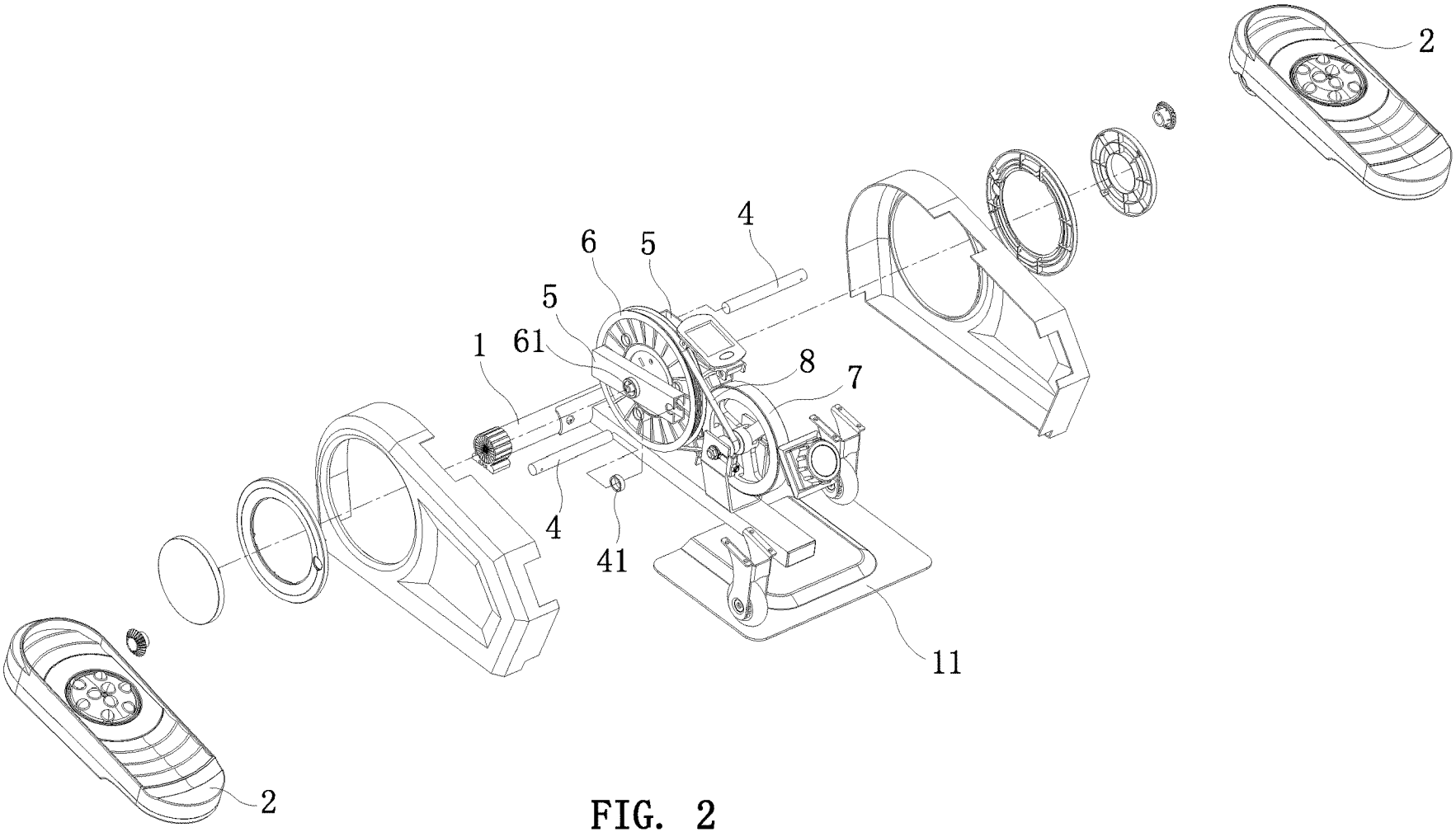
FIG. 2 is an exploded view of the present invention.

As shown in FIG. 1 and FIG. 2, the present invention discloses a fitness equipment provided with massage pedals, comprising a frame 1, two pedals 2, two rotating shafts 4, two flywheel swing arms 5, a flywheel 6, a damping wheel 7, and a belt 8.

The two pedals 2 are symmetrically mounted on the frame 1, and the pedals 2 are provided thereon with massage mechanisms. The pedals 2 are connected to the rotating shafts 4, respectively. An inner end of the rotating shaft 4 is rotatably connected to an outer end of the flywheel swing arm 5 through a bearing 41. A middle portion of the flywheel swing arm 5 is sleeved on an outer end of a flywheel axle 61. The flywheel axle 61 is inserted through the flywheel 6. A middle portion of the flywheel axle 61 is rotatably mounted to the frame 1 through a bearing. The damping wheel 7 is rotatably mounted to the frame 1. The belt 8 is wound on the damping wheel 7 and the flywheel 6.

Figure 3:
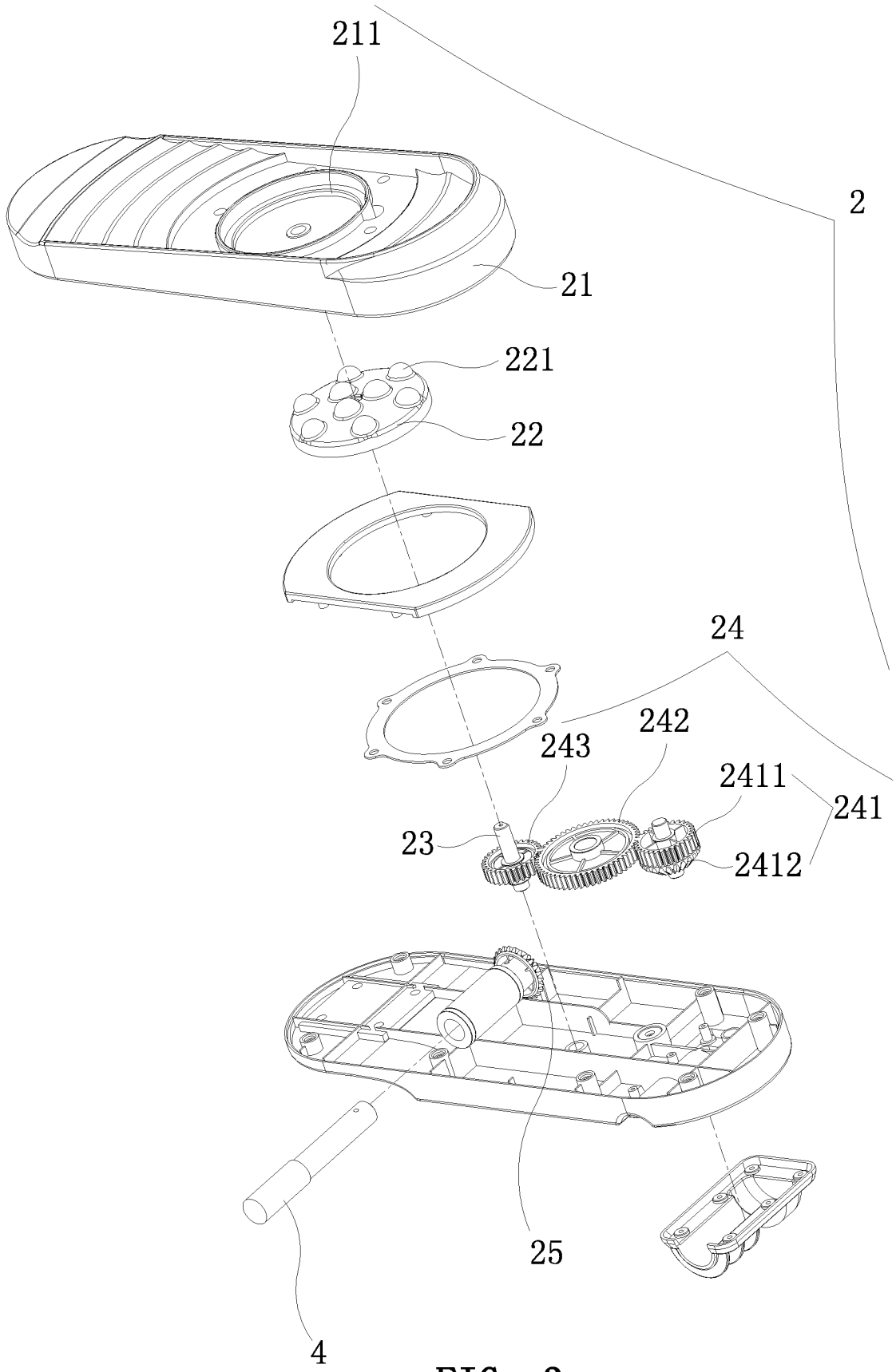
FIG. 3 is an exploded view of the pedal according to a first embodiment of the present invention.
Figure 4:
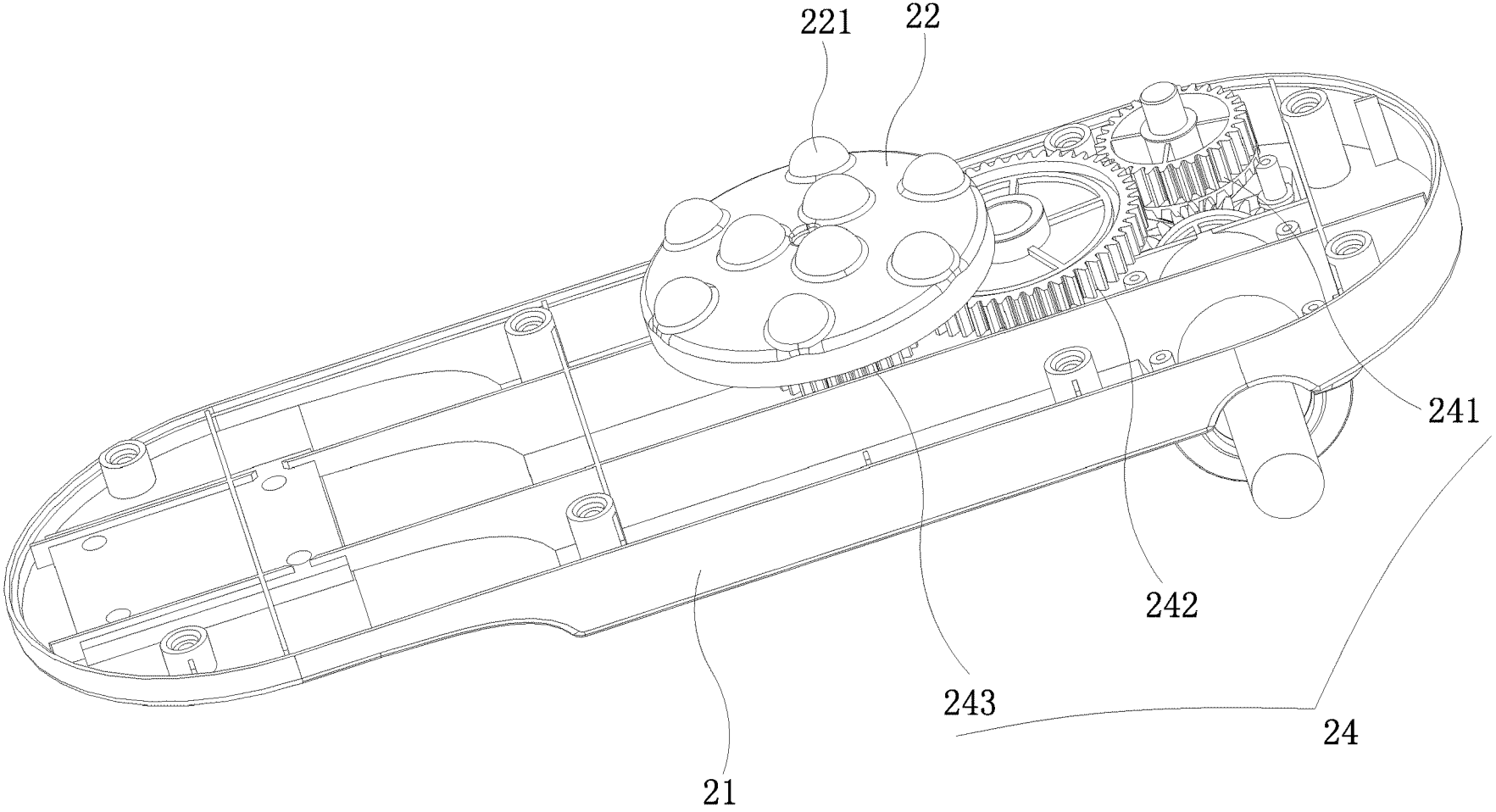
FIG. 4 is a top view of the pedal according to the first embodiment of the present invention.
Figure 5:
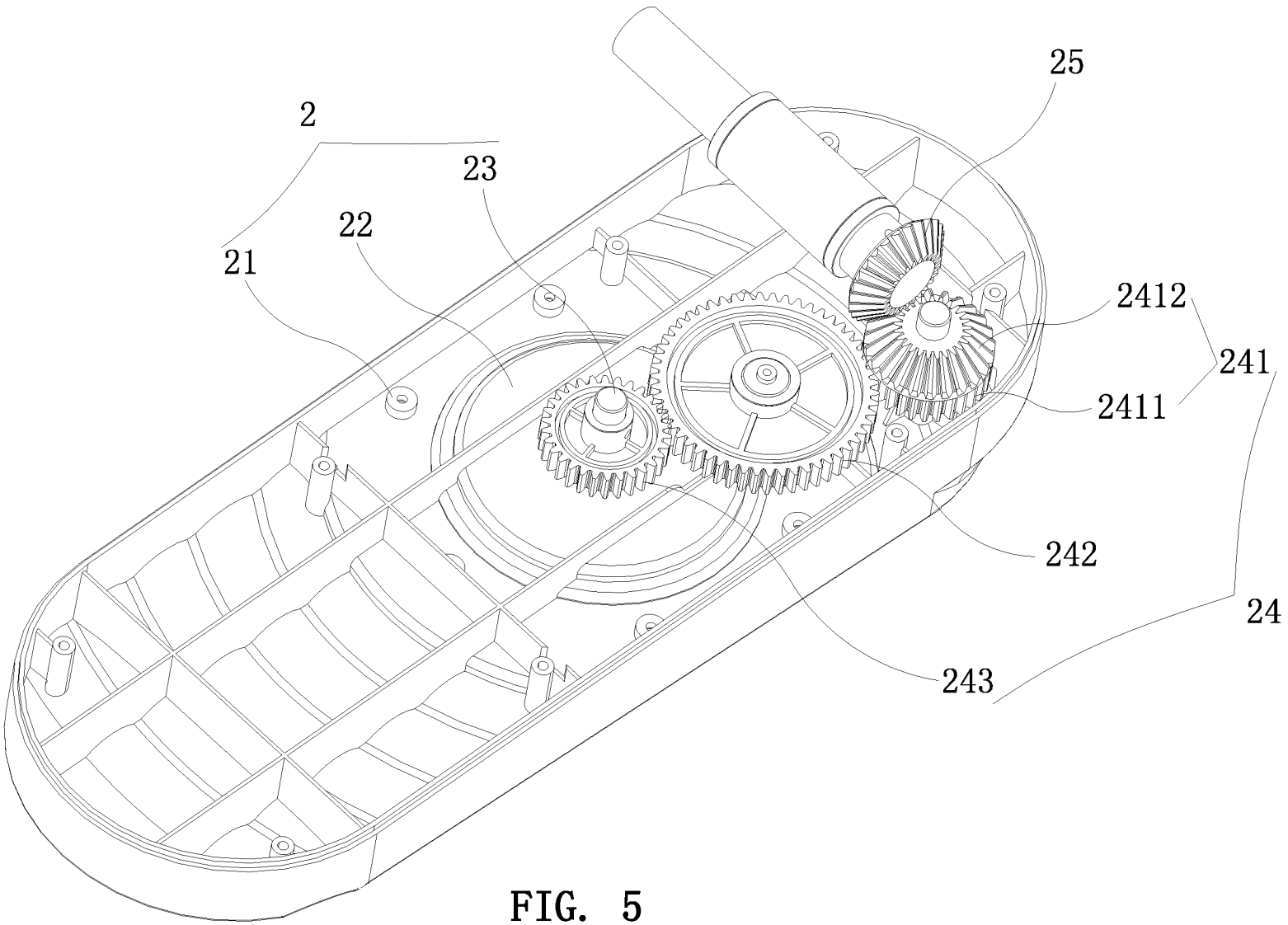
FIG. 5 is a bottom view of the pedal according to the first embodiment of the present invention.

FIGS. 3-5 illustrate a first embodiment of the pedal.

The pedal 2 includes a pedal body 21, a massage disc 22, a disc rotating axle 23, a gear unit 24, and a bevel gear 25. The massage disc 22 is movably installed in a counterbore 211 on a top surface of the pedal body 21. The center of the massage disc 22 is sleeved on an upper end of the disc rotating axle 23. A top surface of the massage disc 22 has a plurality of hemispheres 221 protruding upwardly. A lower end of the disc rotating axle 23 is connected to the gear unit 24. The gear unit 24 is rotatably installed in the pedal body 21 and meshes with the bevel gear 25. The bevel gear 25 is sleeved on an outer end of the rotating shaft 4. One end of the pedal body 21 is equipped with a wheel 26. The wheel 26 is slidably connected to a bottom plate 11 of the frame 1. In this embodiment, the massage disc 22, the disc rotating axle 23, the gear unit 24 and the bevel gear 25 constitute the massage mechanism.

The gear unit 24 includes a small bevel gear 241, a transition gear 242, and a drive gear 243. An upper portion of the small bevel gear 241 is formed with annularly arranged teeth 2411, and a lower portion of the small bevel gear 241 is formed with bevel teeth 2412. The bevel teeth 2412 of the lower portion of the small bevel gear 241 mesh with the bevel gear 25. The annularly arranged teeth 2411 of the upper portion of the small bevel gear 241 mesh with the transition gear 242. The transition gear 242 meshes with the drive gear 243. The drive gear 243 is sleeved on the disc rotating axle 23.

The working principle of the present invention is described below.

When in use, the user treads on the pedals 2, and the rotating shafts 4 drive the flywheel swing arm 5 to rotate the flywheel 6 for a corresponding step workout. At the same time, the pedals 2 do circulation motion by themselves to make the bevel gear 25 rotate and drive the gear unit 24 to rotate. The massage disc 22 is driven to rotate by the disc rotating axle 23, so that the soles of the user's feet are massaged while doing the step workout.

Figure 6:
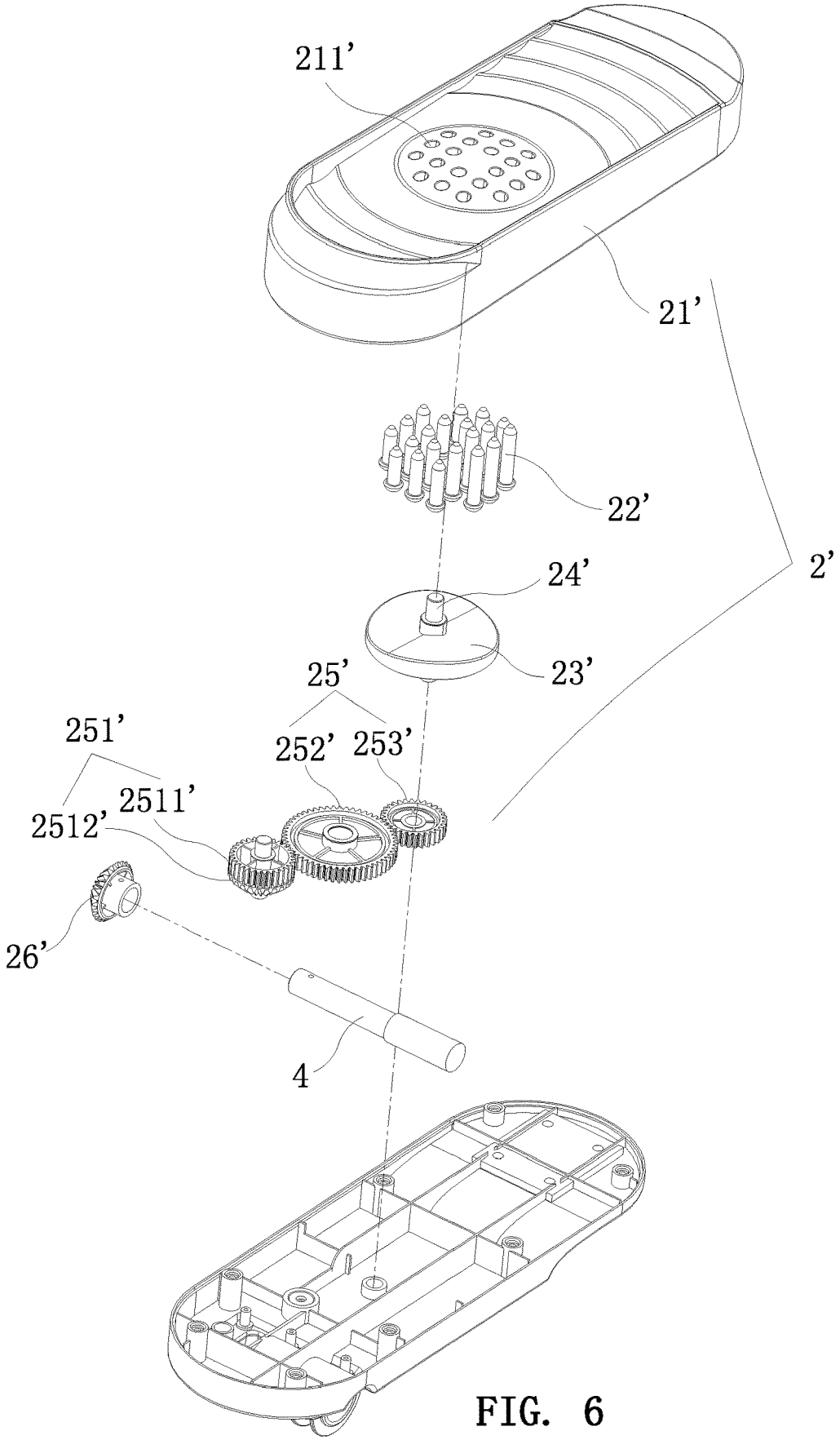
FIG. 6 is an exploded view of the pedal according to a second embodiment of the present invention.
Figure 7:
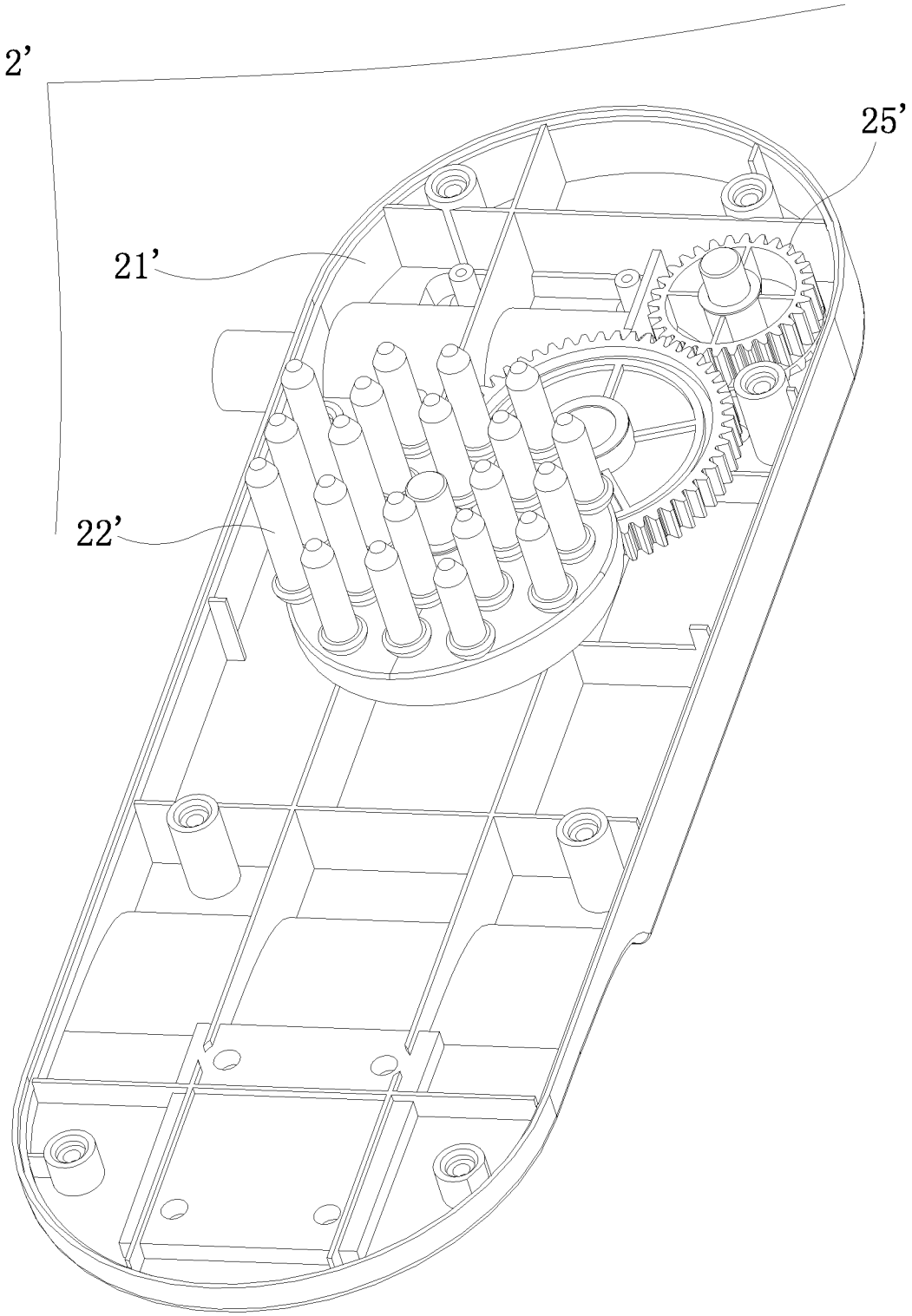
FIG. 7 is a top view of the pedal according to the second embodiment of the present invention.
Figure 8:
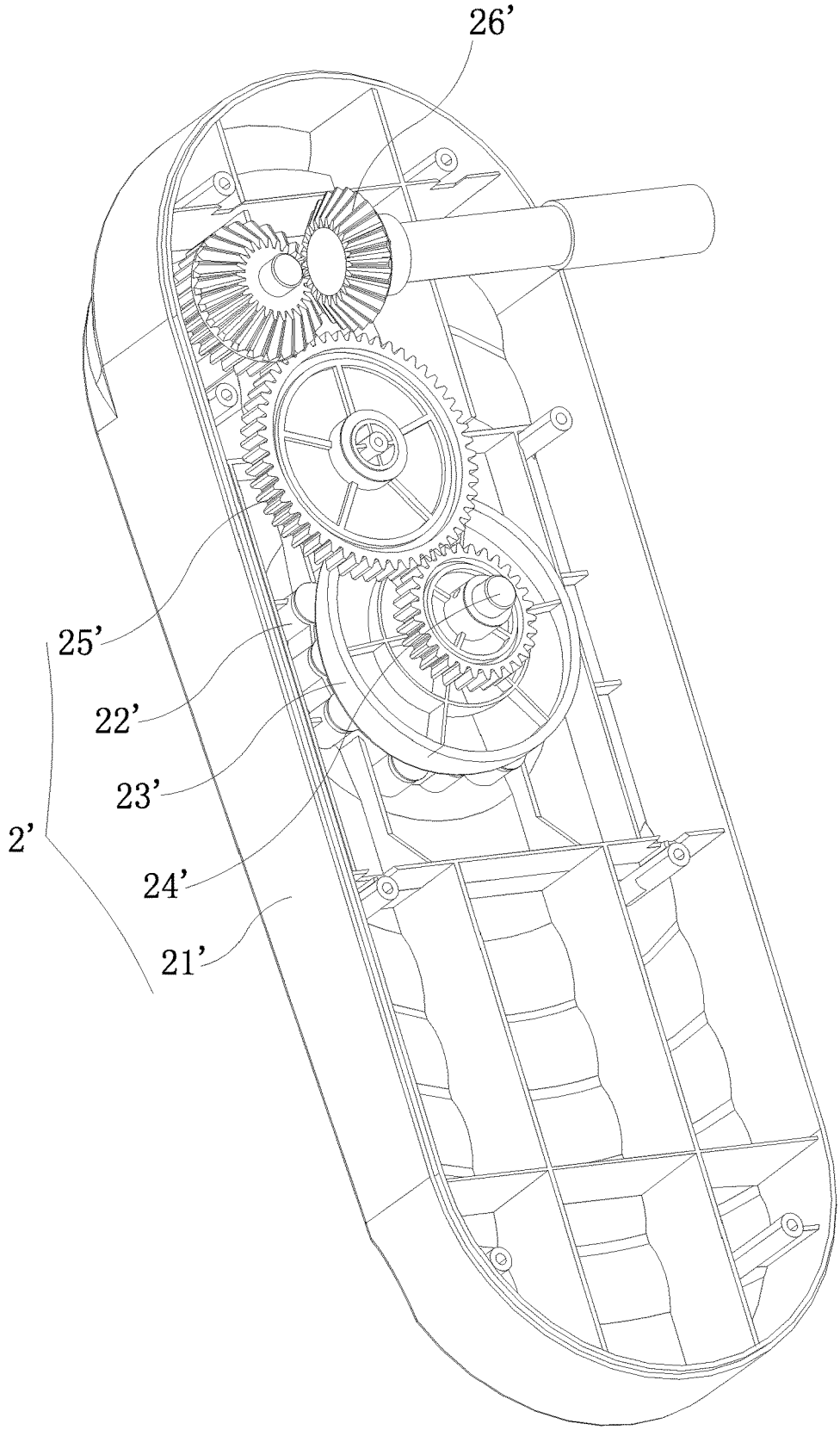
FIG. 8 is a bottom view of the pedal according to the second embodiment of the present invention.

FIGS. 6-8 illustrate a second embodiment of the pedal.

The pedal 2' includes a pedal body 21', massage pins 22', a rotating disc 23', a disc rotating axle 24', a gear unit 25', and a bevel gear 26'. The massage pins 22' are movably inserted in perforations 211' defined in a middle portion of the pedal body 21'. Upper end faces of the massage pins 22' extend out of a top surface of the pedal body 21'. Lower end faces of the massage pins 22' abut against a top surface of the rotating disc 23'. The center of the rotating disc 23' is sleeved on an upper end of the disc rotating axle 24'. The top surface of the rotating disc 23' is a curved surface that curves inward. A lower end of the disc rotating axle 24' is connected to the gear unit 25'. The gear unit 25' is rotatably installed in the pedal body 21' and meshes with the bevel gear 26'. The bevel gear 26' is sleeved on an outer end of the rotating shaft 4. One end of the pedal body 21' is equipped with a wheel. The wheel is slidably connected to a bottom plate 11 of the frame 1. In this embodiment, the massage pins 22', the rotating disc 23', the disc rotating axle 24', the gear unit 25' and the bevel gear 26' constitute the massage mechanism.

The gear unit 25' includes a small bevel gear 251', a transition gear 252', and a drive gear 253'. An upper portion of the small bevel gear 251' is formed with annularly arranged teeth 2511', and a lower portion of the small bevel gear 251' is formed with bevel teeth 2512'. The bevel teeth 2512' of the lower portion of the small bevel gear 251' mesh with the bevel gear 26'. The annularly arranged teeth 2511' of the upper portion of the small bevel gear 251' mesh with the transition gear 252'. The transition gear 252' meshes with the drive gear 253'. The drive gear 253' is sleeved on the disc rotating axle 24'.

The working principle of the present invention is described below.

When in use, the user treads on the pedals 2', and the rotating shafts 4 drive the flywheel swing arm 5 to rotate the flywheel 6 for a corresponding step workout. At the same time, the pedals 2' do circulation motion by themselves to make the bevel gear 26' rotate and drive the gear unit 25' to rotate. The rotating disc 23' is driven to rotate by the disc rotating axle 24'. The rotating disc 23' pushes the massage pins 22' to move up and down, so that the soles of the user's feet are massaged while doing the step workout.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fitness equipment provided with massage pedals, comprising a frame, two pedals, two rotating shafts, two flywheel swing arms, a flywheel, a damping wheel, and a belt; the two pedals being symmetrically mounted on the frame, the pedals being each provided thereon with a massage mechanism, the pedals being connected to the rotating shafts respectively, an inner end of each of the rotating shafts being rotatably connected to an outer end of a respective one of the flywheel swing arms through a first bearing, a middle portion of each of the flywheel swing arms being sleeved on an outer end of a flywheel axle, the flywheel axle being inserted through the flywheel, a middle portion of the flywheel axle being rotatably mounted to the frame through a second bearing, the damping wheel being rotatably mounted to the frame, the belt being wound on the damping wheel and the flywheel.

2. The fitness equipment as claimed in claim 1, wherein the pedals each include a pedal body, massage pins, a rotating disc, a disc rotating axle, a gear unit, and a bevel gear; the massage pins are movably inserted in perforations defined in a middle portion of the pedal body, upper end faces of the massage pins extend out of a top surface of the pedal body, lower end faces of the massage pins abut against a top surface of the rotating disc, a center of the rotating disc is sleeved on an upper end of the disc rotating axle, a lower end of the disc rotating axle is connected to the gear unit, the gear unit is rotatably installed in the pedal body and meshes with the bevel gear, the bevel gear is sleeved on an outer end of the corresponding rotating shaft; the massage pins, the rotating disc, the disc rotating axle, the gear unit and the bevel gear constitute the massage mechanism.

3. The fitness equipment as claimed in claim 2, wherein the top surface of the rotating disc is a curved surface that curves inward.

4. The fitness equipment as claimed in claim 2, wherein the gear unit includes a small bevel gear and a drive gear; an upper portion of the small bevel gear is formed with annularly arranged teeth, a lower portion of the small bevel gear is formed with bevel teeth, the bevel teeth of the lower portion of the small bevel gear mesh with the bevel gear, the annularly arranged teeth of the upper portion of the small bevel gear mesh with the drive gear, and the drive gear is sleeved on the disc rotating axle.

5. The fitness equipment as claimed in claim 4, wherein the gear unit further includes a transition gear; the annularly arranged teeth of the upper portion of the small bevel gear mesh with the transition gear, and the transition gear meshes with the drive gear.

6. The fitness equipment as claimed in claim 2, wherein one end of the pedal body is equipped with a wheel, and the wheel is slidably connected to a bottom plate of the frame.

7. The fitness equipment as claimed in claim 1, wherein the pedals each include a pedal body, a massage disc, a disc rotating axle, a gear unit, and a bevel gear; the massage disc is movably installed in a counterbore on a top surface of the pedal body, a center of the massage disc is sleeved on an upper end of the disc rotating axle, a lower end of the disc rotating axle is connected to the gear unit, the gear unit is rotatably installed in the pedal body and meshes with the bevel gear, the bevel gear is sleeved on an outer end of the corresponding rotating shaft, the massage disc, the disc rotating axle, the gear unit and the bevel gear constitute the massage mechanism.

8. The fitness equipment as claimed in claim 7, wherein a top surface of the massage disc has a plurality of hemispheres protruding upwardly.

9. The fitness equipment as claimed in claim 7, wherein the gear unit includes a small bevel gear and a drive gear; an upper portion of the small bevel gear is formed with annularly arranged teeth, a lower portion of the small bevel gear is formed with bevel teeth, the bevel teeth of the lower portion of the small bevel gear mesh with the bevel gear, the annularly arranged teeth of the upper portion of the small bevel gear mesh with the drive gear, and the drive gear is sleeved on the disc rotating axle.

10. The fitness equipment as claimed in claim 9, wherein the gear unit further includes a transition gear; the annularly arranged teeth of the upper portion of the small bevel gear mesh with the transition gear, and the transition gear meshes with the drive gear.

11. The fitness equipment as claimed in claim 7, wherein one end of the pedal body is equipped with a wheel, and the wheel is slidably connected to a bottom plate of the frame.

* * * * *